US006047587A

United States Patent [19]

Naggert

[11] Patent Number: 6,047,587

[45] Date of Patent: Apr. 11, 2000

[54] APPARATUS FOR A TOOLPACK CRADLE FOR THE EXTRUSION OF ALUMINUM CANS

[75] Inventor: Dieter K. Naggert, Orland Park, Ill.

[73] Assignee: Gerhard Designing & Manufacturing, Inc., Bridgeview, Ill.

[21] Appl. No.: 09/069,449

[22] Filed: Apr. 29, 1998

[51] Int. Cl.[7] ..... B21D 22/28

[52] U.S. Cl. ..... 72/349

[58] Field of Search ..... 72/263, 272, 347, 72/349, 448, 43, 44, 45

[56] References Cited

U.S. PATENT DOCUMENTS

| | | | |
|---|---|---|---|
| 2,245,573 | 6/1941 | Criley | 72/448 |
| 3,889,509 | 6/1975 | Miller et al. | 72/349 |
| 4,852,377 | 8/1989 | Mikas et al. | 72/349 |
| 5,617,755 | 4/1997 | Cheers et al. | 72/349 |

*Primary Examiner*—Lowell A. Larson

*Attorney, Agent, or Firm*—Lee, Mann, Smith, McWilliams, Sweeney and Ohlson

[57] ABSTRACT

An apparatus for a cooled toolpack cradle for the extrusion of aluminum cans. The apparatus comprises a toolpack having more than one tool. The apparatus further comprises a means for delivering aluminum cans into the toolpack. The apparatus further comprises a hardened steel block that is attached to the toolpack and to the base of the toolpack cradle to absorb extrusion forces on the toolpack during the extrusion of aluminum cans. The apparatus further comprises two independently adjustable wedges which by reciprocating means raise or lower the toolpack either uniformly or one end independent of the other. The apparatus further comprises means to preload the adjustment wedges to eliminate backlash. The apparatus further comprises a pad in the toolpack cover to provide the required downward clamping force with coolant passages that connect directly with coolant distribution rings with no intermediate hose connection. Sealing integrity is provided by the elastomer pad since it is in intimate contact with the rings.

13 Claims, 5 Drawing Sheets

3
4
54
50
84
84
18
48
10
36
56
80
64
92
11
38
14
22
28
16
26
42
20
40
24
44
33
32
46
30
76
78
94

APPARATUS FOR A TOOLPACK CRADLE FOR THE EXTRUSION OF ALUMINUM CANS

FIELD OF THE INVENTION

The present invention relates broadly to improvements in aluminum can extrusion toolpack cradles and more particularly in apparatus for vertical adjustment and cooling of the toolpack cradle.

BACKGROUND OF THE INVENTION

Wedge type toolpack cradles have been in use for some time in a wide number of applications. One form of such apparatus employs individual adjustment for each tool with vertically arranged wedges. Since there are four extrusion dies per cradle, eight adjustment wedges/screws were required. Adjustment of the individual wedges/screws made it difficult to achieve proper alignment.

Another existing apparatus reveals an open type cradle similar to the present invention, except no adjustment for vertical tool position is provided other than hardened rails that need to be shimmed to achieve the proper height. Again, the use of shims made it difficult to achieve and to maintain proper alignment.

The extrusion of aluminum cans generates an undesirable amount of heat within the toolpack. Coolant is circulated through coolant rings within the toolpack cradle to remove heat from the tools. In prior designs, three or four coolant distribution rings were individually housed into a common manifold. Removal of the coolant rings was cumbersome and time consuming. It is therefore desirable to eliminate hoses and manifold from the coolant system.

SUMMARY OF THE INVENTION

In one form of the invention the apparatus described herein lends itself to a cooled toolpack cradle having a single means for simultaneously adjusting the height of tools within the toolpack cradle.

The apparatus of the present invention comprises generally the following three groups of components: components forming a toolpack cradle used to extrude aluminum cans; components for simultaneously adjusting the height of the toolpack; and components for cooling the toolpack.

The components forming a toolpack cradle are generally: a toolpack containing at least one tool used to extrude aluminum cans, the toolpack having tapered under surfaces; and a means for delivering aluminum cans into the toolpack.

The components for simultaneously adjusting the height of the toolpack are generally: dual independently adjustable wedges having inclined upper surfaces which move along the tapered under surfaces of the toolpack to adjust the height of the toolpack; reciprocating means which laterally move the dual wedges which in turn raises or lowers the height of the toolpack; and compression springs providing a preload on the dual wedges to eliminate backlash.

Components for cooling the toolpack are generally: a toolpack cover hinged to the top of the toolpack cradle; coolant distribution rings within the toolpack cradle to provide recirculation of coolant fluid around the toolpack; and a pad secured to the underside of the toolpack cover which provides the required downward clamping force with the coolant passages that connect directly with coolant distribution rings with no intermediate hose connection.

The outstanding and unexpected results obtained by the apparatus of this invention are attained by a series of features and elements assembled working together in inter-related combination. The inventive instrument of this application permits the independent alignment of wedges within a toolpack cradle and eliminates the need to deliver toolpack coolant through a series of manifolds and hoses.

OBJECTS OF THE INVENTION

One object of the present invention is to provide an improved apparatus for a toolpack cradle for the extrusion of aluminum cans.

Another object of the present invention is to provide an apparatus to absorb extrusion forces on the toolpack.

A further object of the present invention is to provide an apparatus for independently adjustable wedges that can raise or lower each side of the toolpack uniformly on each end or one end independently of the other.

A still further object of the present invention is to provide an apparatus for preloading the toolpack adjustment wedges to eliminate backlash.

A yet further object of the present invention is to provide an apparatus for introducing cooling fluid into the toolpack cradle coolant distribution rings with no intermediate hose connection.

These and other objects of the present invention will become apparent when reading the enclosed detailed description in view of the drawings.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE PREFERRED EMBODIMENTS

References will now be made in detail to the preferred embodiments of the present invention. While the present invention will be described in conjunction with the preferred embodiments, it shall be understood that such description is not intended to limit the scope of the present invention to the preferred embodiments described below. To the contrary, the present invention is intended to cover other alternatives, modifications, additions, and improvements, all of which may be included within the scope of the present invention, as defined by the claims attached thereto.

Figure 1:
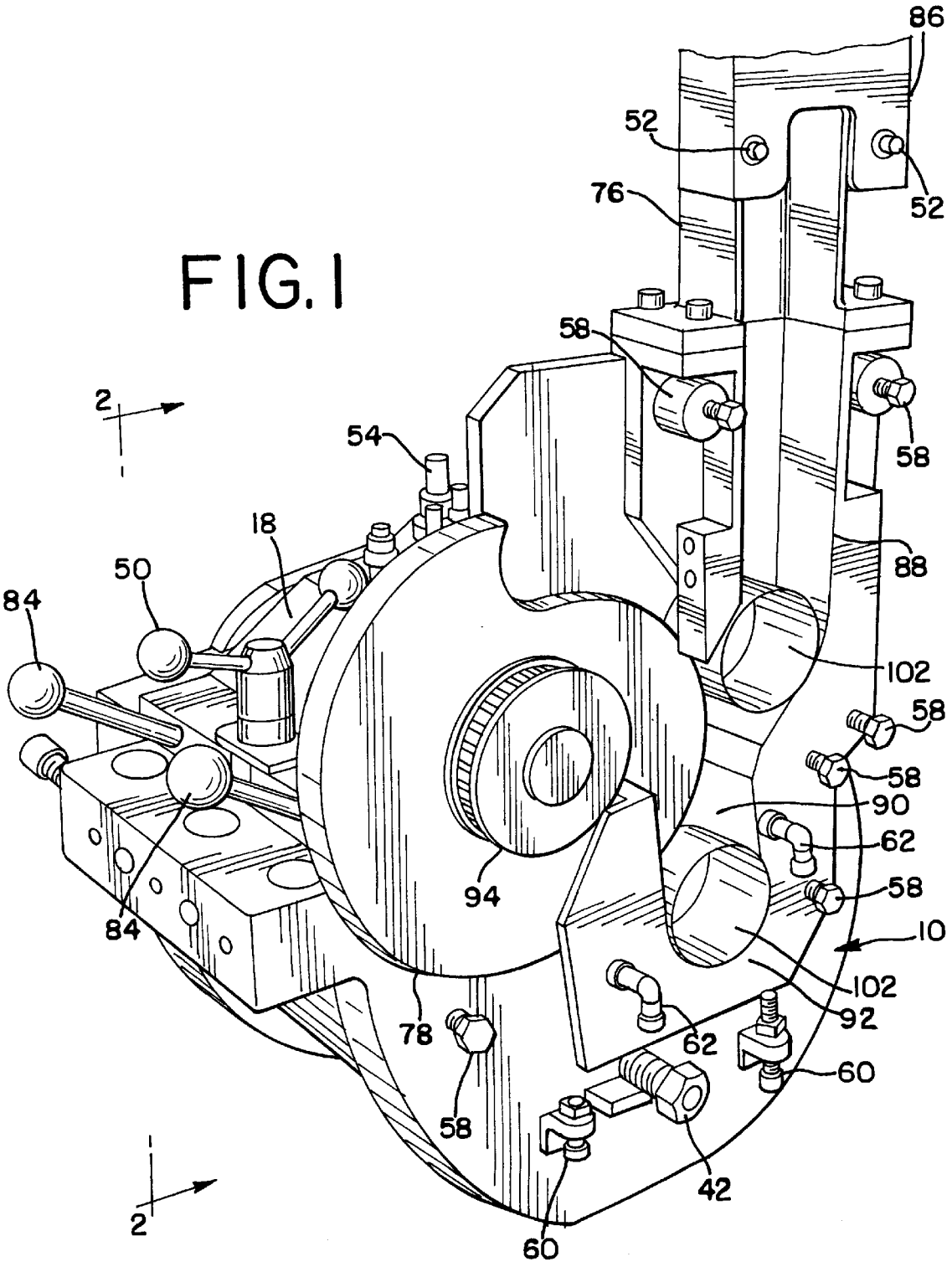
FIG. 1 is a schematic diagram of the typical apparatus that may be used, in accordance with the present invention, for a cooled toolpack cradle for use in aluminum can extrusion.

Referring now to FIG. 1, the cooled toolpack cradle incorporating this invention is indicated generally by numeral 10. Unextruded aluminum cans 102 enter the toolpack cradle 10 through a cup supply 76. A cup supply plate 86 covers the cup supply 76 to keep the aluminum cans 102 within the cup supply 76 while the aluminum cans 102 are conveyed. The cup supply plate 86 is connected to the cup supply 76 by bolts 52. From the cup supply 76, aluminum cans 102 enter a cup feed guide 88. A cup feed turret 78 rotates about a circular hub 94 and advances an aluminum can 102 into a cup locator 90. A ram 82 (not shown) then horizontally advances the aluminum can 102 through the center of a toolpack 11. The cup supply 76, cup feed guide 88, and cup locator 90 are generally connected to the toolpack cradle 10 by bolts 58. Air pressure can be introduced through air fittings 62 to permit the toolpack 11 to be clamped horizontally to the toolpack cradle 10 by means of two air pistons (not shown) integral to the cup locator 90.

Figure 2:
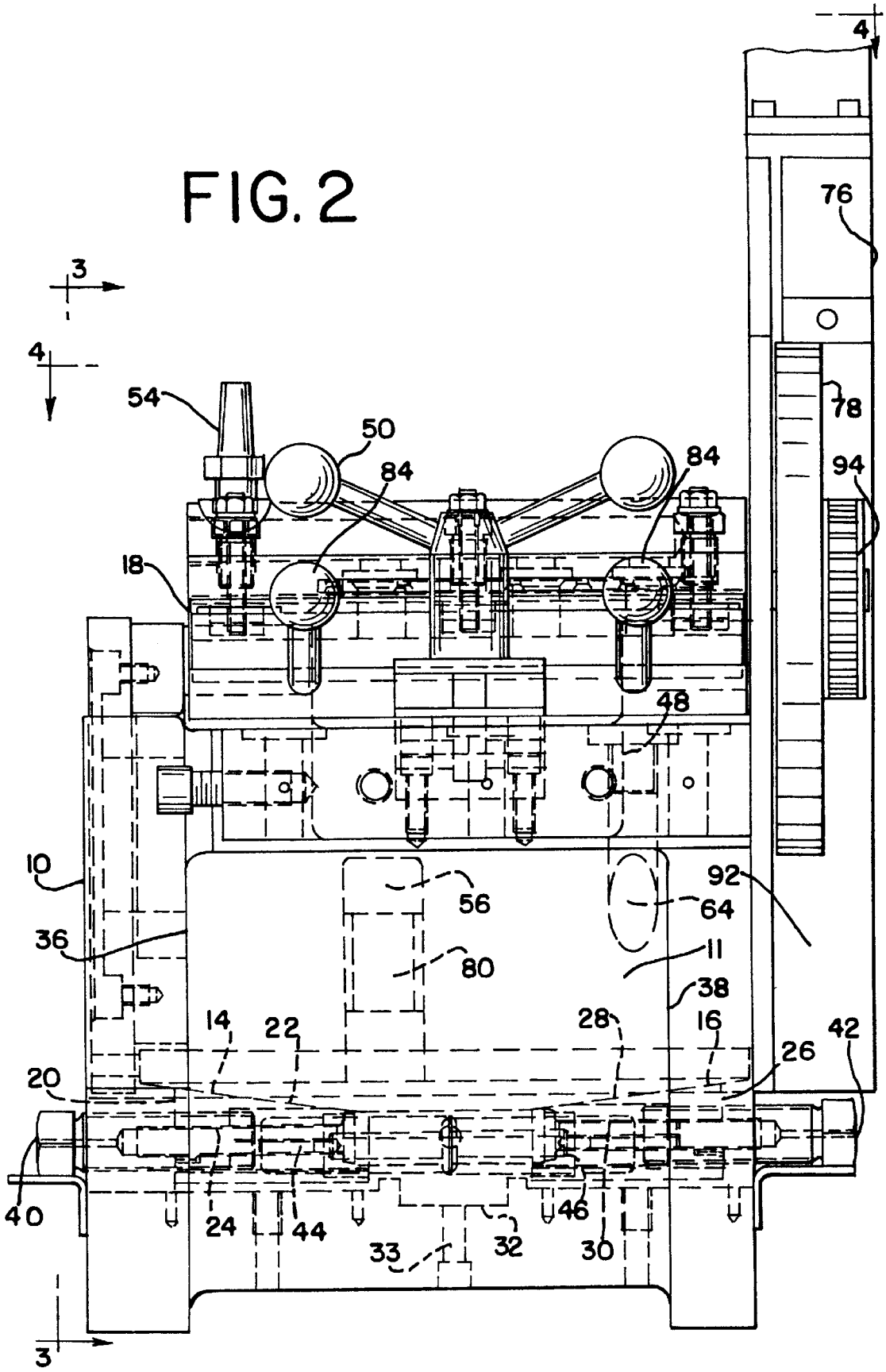
FIG. 2 is a side elevational view taken along the Line 2—2 in FIG. 1 of a cooled toolpack cradle.
Figure 3:
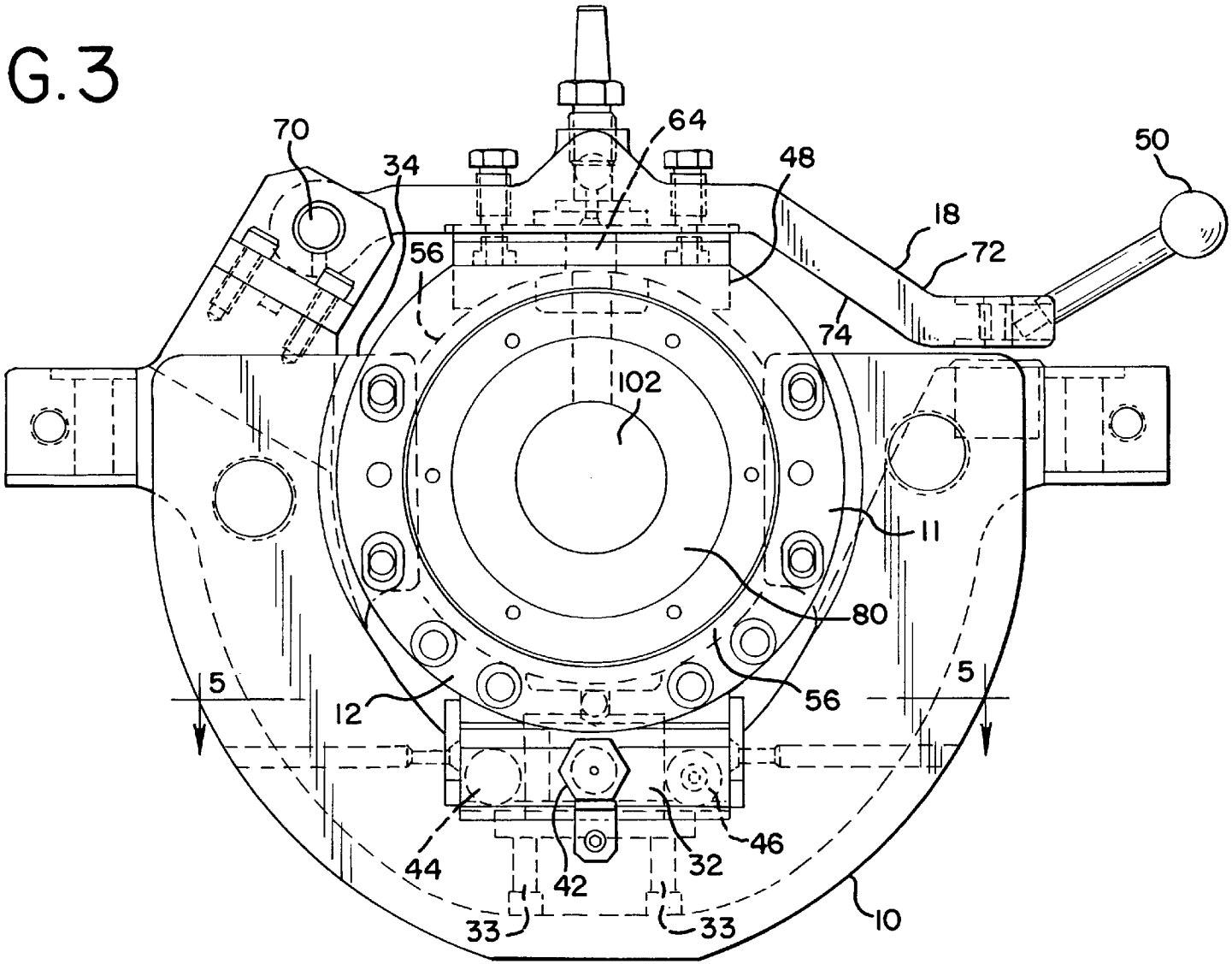
FIG. 3 is a front elevational view taken along the Line 3—3 in FIG. 2 of a cooled toolpack cradle.
Figure 4:
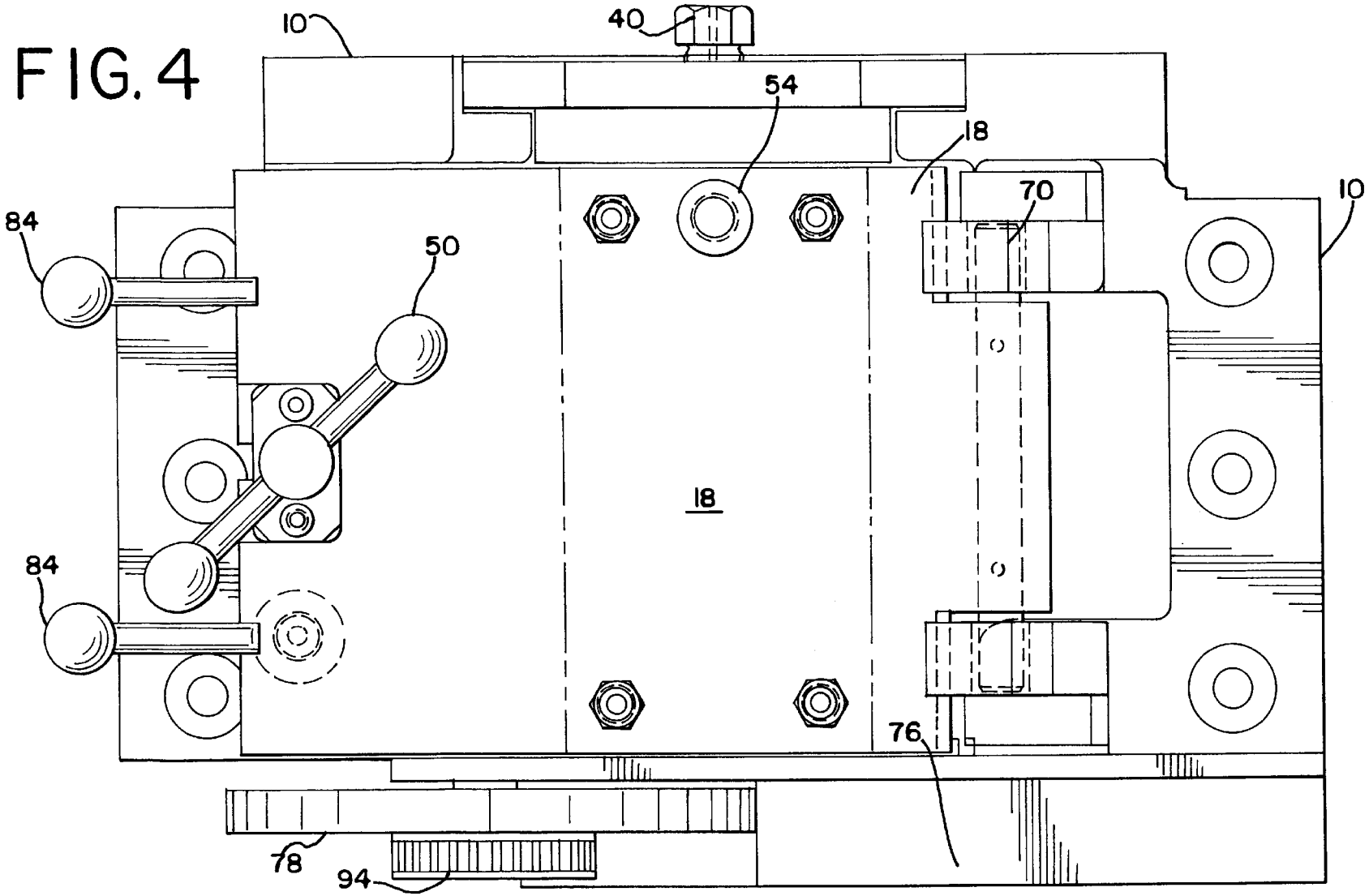
FIG. 4 is a top elevational view taken along the Line 4—4 in FIG. 2 of a cooled toolpack cradle.

Referring now to FIG. 3, the toolpack 11, having a first side 36 (See FIG. 2) and a second side 38 (See FIG. 2), is located within the cavity of the cradle opening 34 of the toolpack cradle 10. The toolpack 11 consists of at least one tool 80. The toolpack 11 is comprised generally of three or more tools 80. The tools 80 possess a pattern (not shown) thru which the aluminum can 102 will be extruded. Aluminum cans 102 are compressed radially against the tools 80, displacing material in the surface of the aluminum cans 102 stretching them axially as they are being pushed through the toolpack by the ram 82. The toolpack 11 is supported by a cradle base 12.

The cradle base 12 sets atop a hardened steel block 32. The hardened steel block 32 fits into the cradle opening 34 and is bolted 33 into the cradle base 12 to make the cradle base 12 stationary. As an aluminum can 102 advances through the toolpack 11, the hardened steel block 32 absorbs forces transmitted from the aluminum can 102 to the cradle base 12.

Figure 6:
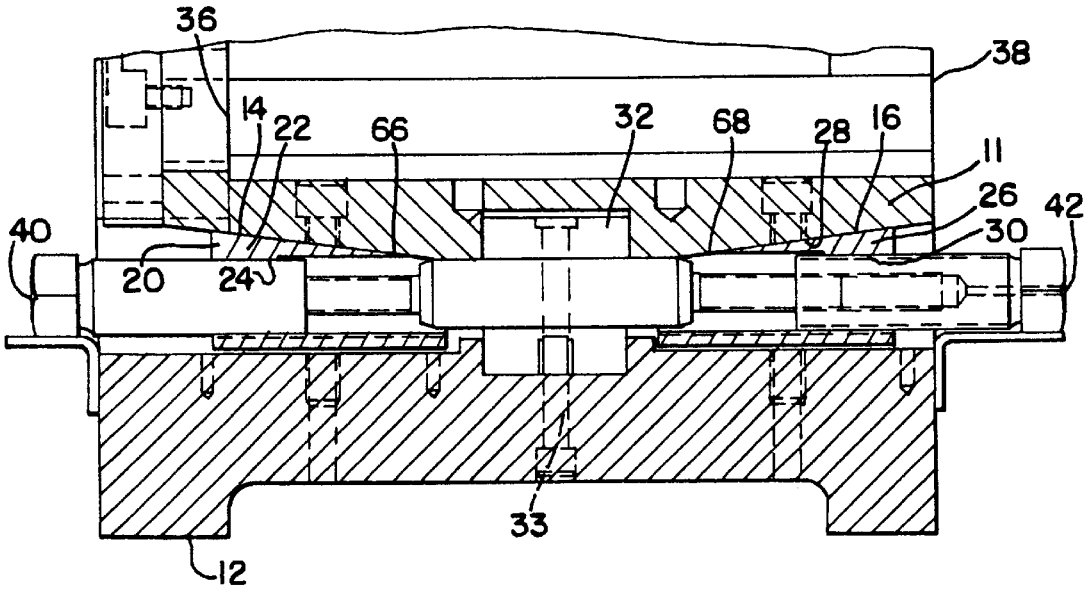
FIG. 6 is a cross section view taken along the Line 6—6 in FIG. 5 of the two individually adjustable wedges and their reciprocating means.

Referring now to FIG. 6, the bottom portion of the cradle base 12 comprises a first tapered surface 14 and a second tapered surface 16. The first tapered surface 14 rests upon the top inclined surface 22 of the first wedge 20. The bottom surface 24 of the first wedge 20 rests upon the toolpack cradle 10. The second tapered surface 16 rests upon the top inclined surface 28 of the second wedge 26. The bottom surface 30 of the second wedge 26 rests on the toolpack cradle 10. The taper of the first tapered surface 14 matches the taper of the top inclined surface 22 of the first wedge 20. The taper of the second tapered surface 16 matches the taper of the top inclined surface 28 of the second wedge 26. The first wedge 20 inclines downward in the direction of the center of the cradle base 12 and ends in the first edge 66. The second wedge 26 inclines downward, from the opposite direction as the first wedge 20, in the direction of the center of the cradle base 12 and ends in the second edge 68.

Each wedge 20 and 26 can reciprocate either inward towards the centerline of the cradle base 12 or outward from the centerline of the cradle base 12. The first wedge 20 and the second wedge 26 are adjusted inward and outward by means of a first reciprocating means 40 and a second reciprocating means 42.

When the first reciprocating means 40 is adjusted such that the first wedge 20 moves inward, force is applied to the first tapered surface 14, resulting in the first side 36 of the cradle base 12 moving upward. Alternatively, when the first reciprocating means 40 is adjusted such that the first wedge 20 moves outward, force is removed from the first tapered surface 14, resulting in the first side 36 of the cradle base 12 moving downward. When the second reciprocating means 42 is adjusted such that the second wedge 26 moves inward, force is applied to the second tapered surface 16, resulting in the second side 38 of the cradle base 12 moving upward. Alternatively, when the second reciprocating means 42 is adjusted such that the second wedge 26 moves outward, force is removed from the second tapered surface 14, resulting in the second side 38 of the cradle base 12 moving downward.

When only one of the wedges 20 or 24 is adjusted, only one side of the cradle base 12 will raise or lower, permitting the toolpack 11 to be tilted. When both of the wedges 20 and 24 are equally adjusted, the first side 36 and the second side 38 of the toolpack 11 will raise or lower uniformly.

When the toolpack 11 is raised or lowered, the tools 80 within the toolpack will in turn raise or lower to match the center portion of the ram 82.

The top inclined surface 22 and the bottom surface 24 of the first wedge 20 form a first edge 66. The top inclined surface 28 and the bottom surface 30 of the second wedge 26 form a second edge 68.

In the preferred embodiment, the top inclined surfaces 22 and 28 of the first wedge 20 and the second wedge 26 match the taper of the first and second tapered surfaces 14 and 16. The top inclined surfaces 22 and 28 are in contact with the first and second tapered surfaces 14 and 16, causing a load upon the top inclined surfaces 22 and 28 when the wedges 20 and 26 are reciprocated. Alternatively, the top inclined surface 22 and the top inclined surface 28 can be machined with a large radius to allow reciprocation of the wedges 20 and 26 without edge loading.

In one embodiment of the invention, the first and second reciprocating means 40 and 42 can be differential screws.

Figure 5:
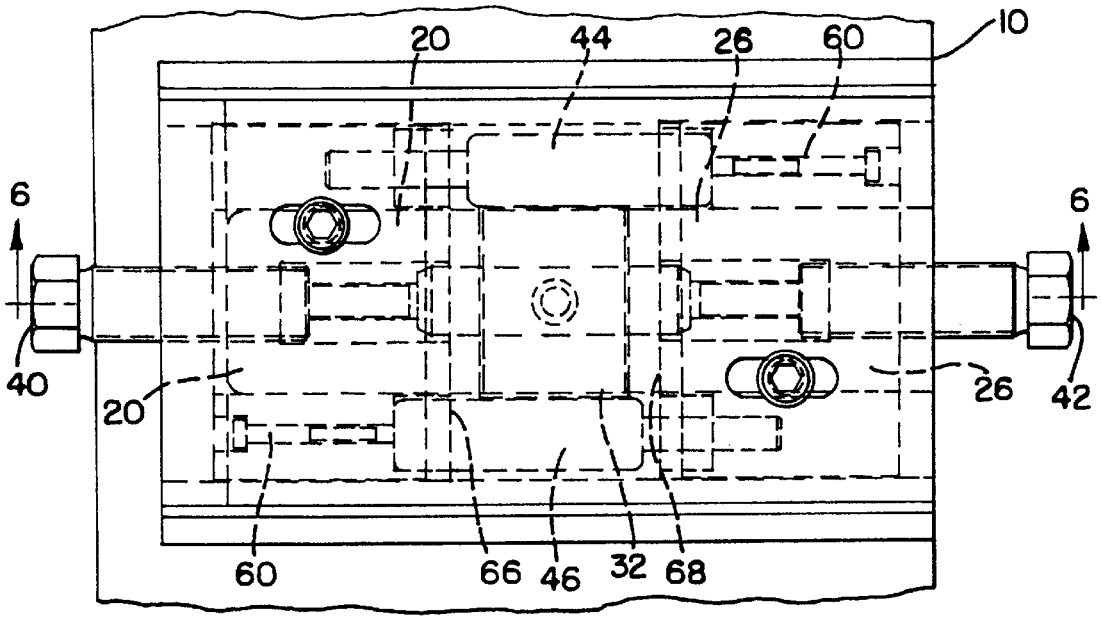
FIG. 5 is a top elevational view taken along the Line 5—5 in FIG. 3 of the two individually adjustable wedges and their reciprocating means and preload means.

Referring now to FIG. 5, first and second preload means 44 and 46 provide a preload on the adjustment of the first and second wedges 20 and 26 to eliminate backlash. When the first reciprocating means 40 is adjusted to reciprocate the first wedge 20 away from the centerline of the cradle base 12, the weight of the toolpack 11 forces or causes backlash on the first wedge 20 away from the centerline of the toolpack 11. The first preload means 44 provides a continuous counter-force on the first wedge 20, in the direction of the centerline of the cradle base 12, in order to eliminate backlash on the first wedge 20 when the first reciprocating means 40 is adjusted.

When the second reciprocating means 42 is adjusted to reciprocate the second wedge 26 away from the centerline of the cradle base 12, the weight of the toolpack 11 forces or causes backlash on the second wedge 26 away from the centerline of the toolpack 11. The second preload means 46 provides a continuous counter-force on the second wedge 26, in the direction of the centerline of the toolpack 11, in order to eliminate backlash on the second wedge 26 when the second reciprocating means 42 is adjusted.

The first and second preload means 44 and 46 are connected to the toolpack cradle by bolts 60.

In one embodiment of the invention, the first and second preload means 44 and 46 are compression springs. In an alternate embodiment of the invention, the first and second preload means 44 and 46 are gas pressurized cylinders.

Referring now to FIG. 3, the hinge 70 connects the toolpack cover 18 to the toolpack cradle 10. The toolpack cover 18 has a top surface 72 and a bottom surface 74. A locking screw 50 is used to clamp the bottom surface 74 of the toolpack cover 18 to the toolpack 11. Handles 84 are used to lift the toolpack cover 18.

At least one coolant distribution ring 56 is located within the cradle opening 34 to provide heat transfer from the toolpack 11 during aluminum can extrusion. The number of coolant distribution rings 56 used will be determined by the number of tools 80. One coolant distribution ring 56 sits adjacent to each tool 80.

An elastomer pad 48 is bolt connected to the bottom surface 74 of the toolpack cover 18. Coolant enters the top surface 72 of the toolpack cover 18 at the coolant inlet 54. Coolant then flows through a fluid conduit 64 within the elastomer pad 48 and in fluid coupling directly into the coolant distribution ring 56. Sealing integrity is provided by the elastomer pad 48 since it is in intimate contact with the at least one coolant distribution ring 56. As coolant fluid flows through a coolant distribution ring 56, heat is drawn away from the tool 80 which the coolant distribution ring 56 supplies with coolant in a generally axial direction.

Various features of the invention have been particularly shown and described in connection with the illustrated embodiments of the invention, however, it must be understood that these particular arrangements merely illustrate and that the invention is to be given its fullest interpretation within the terms of the appended claims.

I claim:

1. A Device for the extrusion of aluminum cans comprising:

a cooled toolpack cradle having more than one extrusion tool and having a single operable means for simultaneously adjusting the height of said tools.

2. A Device of claim 1 including:

a means for extruding said aluminum cans;

a means for delivering aluminum cans into said toolpack cradle; and a cradle base having tapered surfaces operable for simultaneously adjusting the height of said tools and supporting said tools.

3. The Device of claim 2 including:

a first wedge having a top inclined surface, a bottom surface and a first edge, said first wedge being located beneath one of said tapered surfaces and said bottom surface glides reciprocally on said cradle base;

a second wedge having a top inclined surface, a bottom surface and a second edge, said second wedge located beneath another of said tapered surfaces with said bottom surface gliding reciprocally on said cradle base; and a means for laterally reciprocating said first and second wedges.

4. The Device of claim 3 wherein said top inclined surfaces of said first and second wedges substantially exactly match the tapers of said tapered surfaces.

5. The Device of claim 3 wherein said top inclined surfaces of said first and second wedges are machined with a large radius to allow angular adjustment of said toolpack cradle without edge loading.

6. The Device of claim 3 wherein said means for laterally reciprocating said first and second wedges is a differential screw.

7. The device of claim 3, including a pre-load means to provide a counter-force on at least one of the wedges.

8. The Device of claim 7 wherein said preload means is a compression spring.

9. The Device of claim 7 wherein said preload means is a gas pressurized cylinder.

10. A Device for the extrusion of aluminum cans comprising:

a toolpack cradle having more than one extrusion tool and having a single operable means for simultaneously adjusting the height of said tools;

a means for delivering aluminum cans into said toolpack cradle;

a means for extruding said aluminum cans;

a cover connected to said cradle, said cover having a top surface and a bottom surface; and a tubeless means operably connected to said cover for cooling said tools.

11. The Device of claim 10 wherein said means for cooling said tools includes:

a pad secured to the bottom surface of said cover, said pad having a fluid conduit therein;

at least one coolant distribution ring within said toolpack cradle and adapted to cool said tools, said coolant distribution ring being in fluid coupling with said pad when said toolpack cover is in a closed position; and such that coolant fluid can be directed into said coolant distribution ring through said cover and said pad.

12. The Device of claim 11 wherein said pad is polyurethane.

13. A Device for the extrusion of aluminum cans comprising:

a cooled toolpack cradle having more than one extrusion tool and having a single operable means for simultaneously adjusting the height of said tools;

a means for extruding said aluminum cans;

a means for delivering aluminum cans into said toolpack cradle;

said toolpack cradle having tapered surfaces operable for simultaneously adjusting the height of said tools and having a base;

a first wedge having a top inclined surface, a bottom surface and a first edge, said first wedge located beneath one of said tapered surfaces with said bottom surface gliding reciprocally on said cradle base;

a second wedge having a top inclined surface, a bottom surface and a second edge, said second wedge located beneath another of said tapered surfaces with said bottom surface gliding reciprocally on said cradle base;

a means for laterally reciprocating said first and second wedges;

a cover connected to said cradle, said cover having a top surface and a bottom surface;

a pad secured to the bottom surface of said cover, said pad having a fluid conduit therein;

at least one coolant distribution ring within said toolpack cradle and adapted to cool said tools, said coolant distribution ring being in fluid coupling with said pad when said toolpack cover is in a closed position; and such that coolant fluid can be directed into said coolant distribution ring through said cover and said pad.

* * * * *